US005794365A

United States Patent [19]

Hindermeyer et al.

[11] Patent Number: 5,794,365

[45] Date of Patent: Aug. 18, 1998

[54] METHOD AND APPARATUS FOR TURNING A PAGE IN A BOOK

[75] Inventors: Erich Hindermeyer, Dettenhausen; Siegbert Link, Wildberg; Eckhard Kunigkeit, Stuttgart, all of Germany

[73] Assignee: International Business Machines Corporation, Armonk, N.Y.

[21] Appl. No.: 439,533

[22] Filed: May 11, 1995

[30] Foreign Application Priority Data

May 27, 1994 [EP] European Pat. Off. ..... 94108241

[51] Int. Cl.[6] ..... G09F 11/00

[52] U.S. Cl. ..... 40/476; 40/531; 84/487

[58] Field of Search ..... 40/476, 531, 532; 84/487, 502, 517

[56] References Cited

U.S. PATENT DOCUMENTS

| | | | |
|---|---|---|---|
| 4,545,141 | 10/1985 | Ito et al. | 84/487 X |
| 4,700,497 | 10/1987 | Sato et al. | 40/531 |
| 4,870,258 | 9/1989 | Mochizuki et al. . | |
| 5,247,755 | 9/1993 | Sato et al. | 40/531 X |
| 5,286,956 | 2/1994 | Mochizuki | 40/531 X |

FOREIGN PATENT DOCUMENTS

| | | | |
|---|---|---|---|
| 235458 | 9/1987 | European Pat. Off. . | |
| 439934 | 8/1991 | European Pat. Off. . | |
| 503476 | 9/1992 | European Pat. Off. . | |
| 2211826 | 7/1989 | United Kingdom | 40/531 |
| 2222819 | 3/1990 | United Kingdom . | |
| 459438 | 12/1991 | United Kingdom . | |

OTHER PUBLICATIONS

Auto Turn Page Mechanism for Passbook Printer, Technical Disclosure Bulletin (TDB) JA987-0010, vol. 30, No. 11, Apr. 1988.

*Primary Examiner*—Brian K. Green
*Attorney, Agent, or Firm*—K. A. Seaman; Ohlandt, Greeley, Ruggiero & Perle

[57] ABSTRACT

A method and apparatus for safe and fast turning of a page in a book is taught which is more flexible with respect to the varying characteristics of the applied books, is independent of the mechanical and electrical tolerances of the system and from system wear and tear. The method comprises the steps of: applying an initial value of a contact force between a page lifter and the page and/or an initial value of a contact time for the contact between the page lifter and the page, and increasing the value of the contact force and/or contact time when no page has been lifted during a page turning procedure; whereby the last applied value of the contact force and/or contact time is applicable as the initial value when a next page is provided to be turned over.

22 Claims, 5 Drawing Sheets

| BACKWARD | | | |
|---|---|---|---|
| FORWARD | | | |
| PAGE # | INITIAL VALUE | MINIMUM VALUE | MAXIMUM VALUE |
| 0 | | | |
| 1 | | | |
| 2 | | | |
| 3 | | | |
| • • • | | | |
| 15 | | | |

9
"TURN PAGE"
12
INITIALIZE PTOP COUNTER
INITIALIZE TURN PAGE RETRY COUNTER
13
CHECK PAGE
20 BWD
OK
16
"PAGE AVAILABLE"
18 FWD
TURN BACKWARD
TURN FORWARD
54
PREPARE FOR TURN PAGE BACKWARD
21
PREPARE FOR TURN PAGE FORWARD
22
INITIALIZE LIFT RETRY COUNTER
INCREASE TURN PAGE RETRY COUNTER
24
PAGE TURNING OVER PROCEDURE
INCREASE LIFT RETRY COUNTER
INCREASE PTOP COUNTER

METHOD AND APPARATUS FOR TURNING A PAGE IN A BOOK

FIELD OF THE INVENTION

The invention relates to a method for turning a page of a book comprising applying an initial value of a contact force between a lifting means and the page and/or an initial value of a contact time for contact between the lifting means and the page.

BACKGROUND OF THE ART

Automatically turning a page in a book has recently become an object in many kind of applications, such as automatic book readers or book scanners or especially in passbook printers. The safe and fast handling of the page turning process is the main condition of the entire process. When confidential data are concerned, for example in banking applications, a reliable page turning process is necessary.

EP-A-503476 (Hitachi) discloses a booklet printer and handling apparatus for use in a bank terminal device. A twistingly curved portion, disposed obliquely relative to a direction of transfer of the booklet, is provided at a booklet transfer passage. A page to be turned by a page-turning roller is caused to strike against this twistingly curved portion.

In an article by A. Nishimoto entitled "Auto turn page mechanism for passbook printer", IBM Technical Disclosure Bulletin, vol. 30, no. 11, April 1988, a passbook printer is described having an auto turn page (ATP) feature in which a passbook page is automatically turned for printing transactions. The teaching of this article is the closest prior art known to the inventor hereof.

In order to prevent multiple page turning according to Nishimoto, the buckling load of a page is required to be larger than the frictional or adhesive force between pages, but as small as possible. On the other hand, the buckling load is directly proportional to its persistence and inversely proportional to the square of the distance l between the joint of the book and the contact point of the page lifting means. Since the persistence of a page depends on its thickness, the buckling load of the page also depends on its thickness.

For making the ATP mechanism of Nishimoto applicable to any page thickness or any kind of passbook, the buckling load of the page must be controlled to meet the requirement that it be larger than the frictional force between the pages. This is accomplished by positioning the passbook to provide the appropriate distance l depending on the page or passbook. Each passbook is provided with data about the thickness of the page in a magnetic stripe applied thereon and, when the passbook is to be printed or, turned over, the data is read and the passbook placed to provide the predetermined appropriate distance l.

An apparatus and method for turning a page in a book, preferably a savings passbook, is introduced in European Patent Application EP-A-94108261.2, entitled "Apparatus for turning over a page in a book", filed on even date herewith (Attorney docket no.: GE994011). It provides for reduced installation dimensions, a minimized transportation distance of the book during the process of turning of a page, an optimized touching of a page lifting means on the page to be turned, and the ability to turn pages in either direction. The apparatus comprises lifting means for lifting the page, a first transportation means for transporting the book in a horizontal direction substantially perpendicular to the joint of the book, and swivelling means coupled to the lifting means and rotatable around a pivot.

Each page turning apparatus according to the prior art provides a specific way of turning a page in a book. However, the page turning process could be improved to accommodate varying characteristics of applied books due to different materials and different states of the books. Also, normal wear and tear of the mechanical and electrical assembly in such apparatus reduces the reliability of the process and can lead to significant malfunctions.

It is therefore an object of the invention to provide a method and apparatus for safe and fast turning of a page in a book which accommodates varying characteristics of the applied books.

It is another object of the invention to provide a method and apparatus for turning a page in a book which is independent of mechanical and electrical tolerances of the system, and independent of wear and tear of the system.

It is another object of the invention to provide a method and apparatus for turning a page in a book which optimizes the required values of contact time and/or contact force between a page to be turned and the lifting means, and further reduces the number of retries of a page turning procedure after an unsuccessful try.

It is another object of the invention to provide a method and apparatus for turning a page in a book which reduce the processing time for turning the page.

It is another object of the invention to provide a method and apparatus for turning a page in a book which requires no further external information about the state of the book such as a magnetic stripe.

SUMMARY OF THE INVENTION

The objects of the invention are solved by increasing the value of the contact force and/or contact time when no page has been lifted during a page turning procedure, whereby the last applied value of the contact force and/or contact time is applicable as the initial value when a next page is provided to be turned.

The method according to a further embodiment comprises a step of decreasing the value of the contact force and/or contact time when more than one page has been lifted during the page turning procedure. This is to avoid a damaging of the page and to optimize the value of the contact force and/or contact time.

In another embodiment, the last applied value of the contact force and/or contact time is only applied as an initial value, when a given value of the difference between the current initial value and the last applied value is not exceeded. This reduces the affect of an extraordinary stray value out of the normal sequence of contact force and/or contact time values.

The method of another embodiment further comprises a step of checking the number of the page to be turned in the book and/or the height of the page relative to the back of the book, whereby the initial value of the contact force and/or contact time is selectable dependent on the number of the page and/or the height of the page relative to the back of the book and the direction of page turning in the book. This allows a precise control of contact force and/or contact time values.

The method of another embodiment further comprises a step of repositioning the page relative to the lifting means when the page turning procedure was unsuccessful for a predetermined number of times. This avoids unnecessary repetitions of the page turning procedure.

In another embodiment, the procedure for turning one page is only applicable for a second predetermined number of times. This avoids unnecessary repetitions of the page turning procedure on one page when presumably another error happened and it is unlikely that the page turning process can be successfully accomplished.

The objects of the invention are further solved by an apparatus comprising lifting means for lifting the page; and control means for controlling the contact force between the lifting means and the page and/or the contact time for contact between the lifting means and the page; whereby the value of the contact force and/or contact time is increasable when no page has been lifted during a page turning procedure. The value of the contact force and/or contact time is decreasable when more than one page has been lifted during the page turning procedure. The last applied value of the contact force and/or contact time is applicable as an initial value when a next page is provided to be turned.

In another embodiment, the applicable value of the contact force and/or contact time is in a range between a minimum and a maximum value. This is in order to avoid damaging the book due to a too high value of contact force and/or contact time.

In another embodiment, the applicable values of the contact force and/or contact time and the initial values of the contact force and/or contact time are stored. This allows a continuous adaption of the initial values to changing characteristics of the apparatus from normal wear and tear, and to changing characteristics due to different page materials and the state of the books.

In another embodiment the initial value of the contact force and/or contact time is interactively teachable. This allows a flexible handling of various kinds of books with different characteristics.

DESCRIPTION OF THE DRAWINGS

The invention will now be described by way of example and with reference to the accompanying drawings in which.

DETAILED DESCRIPTION OF THE INVENTION

Figure 1:
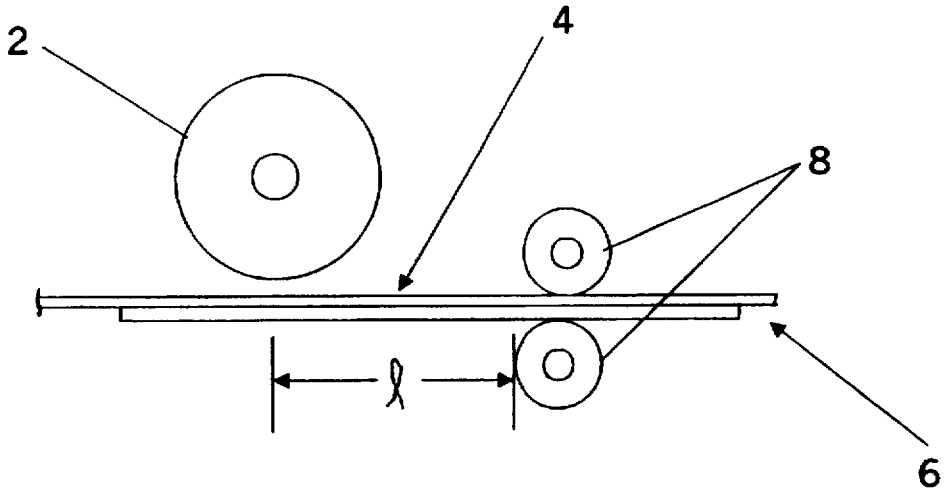
FIG. 1 to FIG. 8 show a sequence of steps for turning a page.
Figure 2:
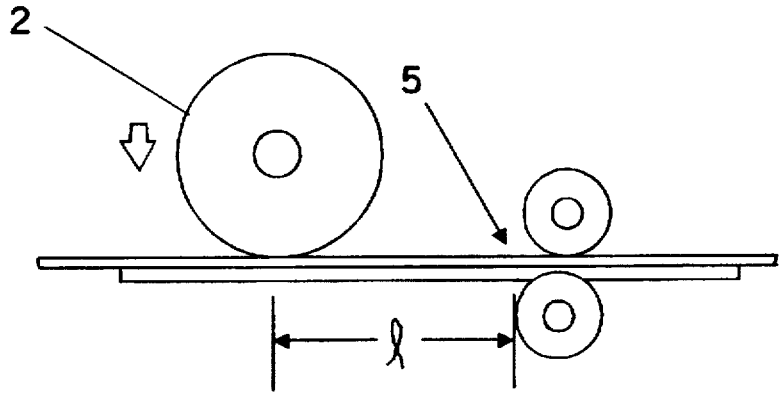
Figure 3:
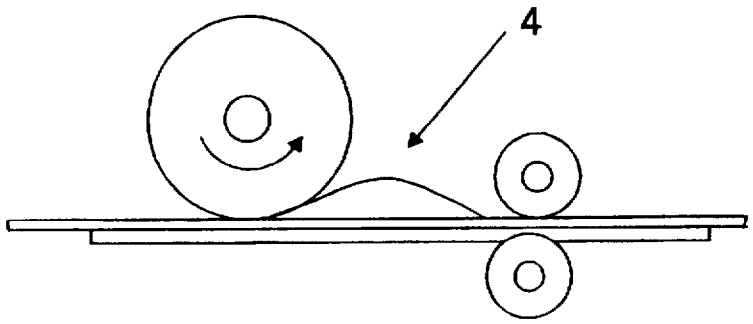
Figure 4:
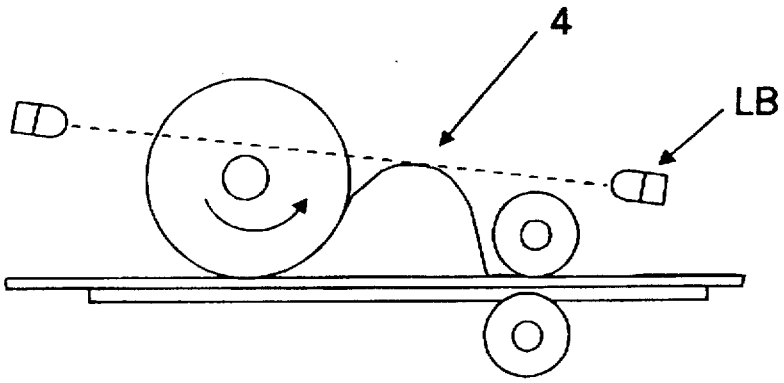
Figure 5:
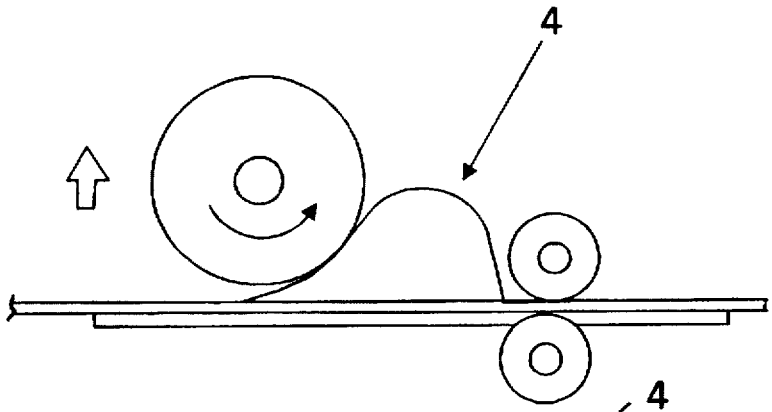
Figure 6:
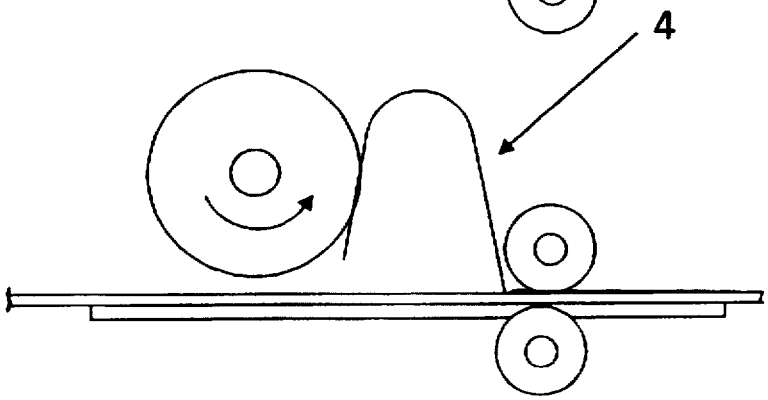
Figure 7:
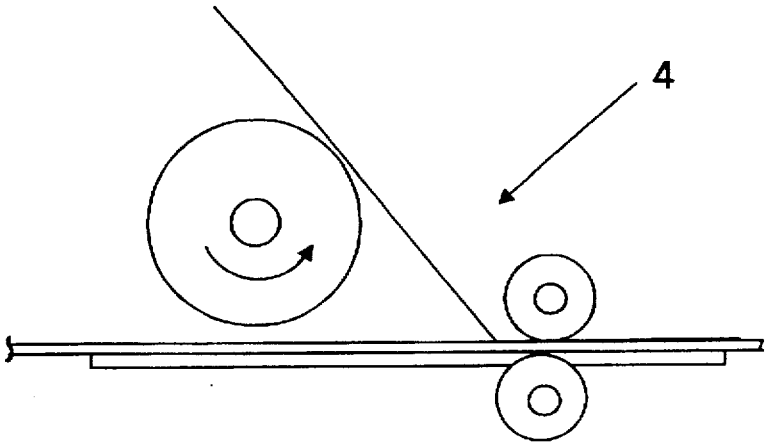
Figure 8:
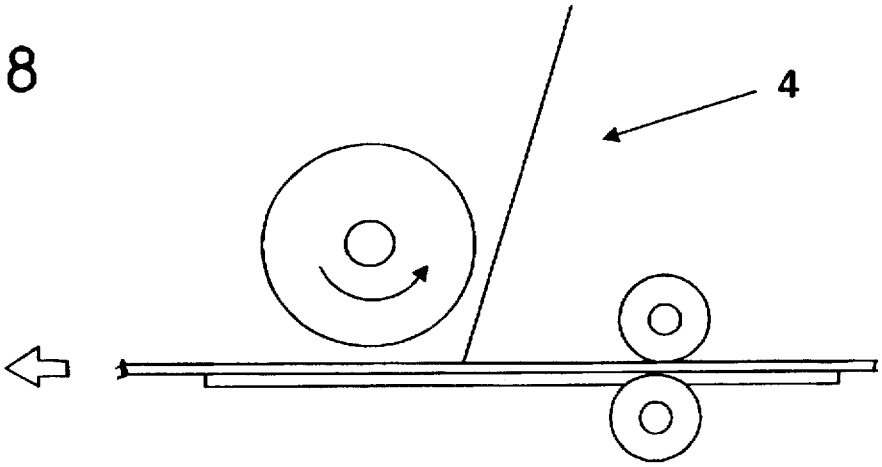

The steps of turning a page are shown in the sequence of FIGS. 1 to FIG. 8. A friction roller 2, as a lifting means, is brought into contact with the page 4 at a distance l from the joint 5 of a passbook 6. Distance l depends on the thickness or persistence of page 4 and enables roller 2 to turn page 4 without turning multiple pages. Friction roller 2 is rotated to frictionally grab and flip up page 4 (FIGS. 1–7). As shown in FIG. 8, passbook 6 is moved by transportation rollers 8 to turn the page 4. It is to be understood that any kind of page lifting means known in the art can be used instead of friction roller 2, for example, underpressure means.

Figures 9, 11:
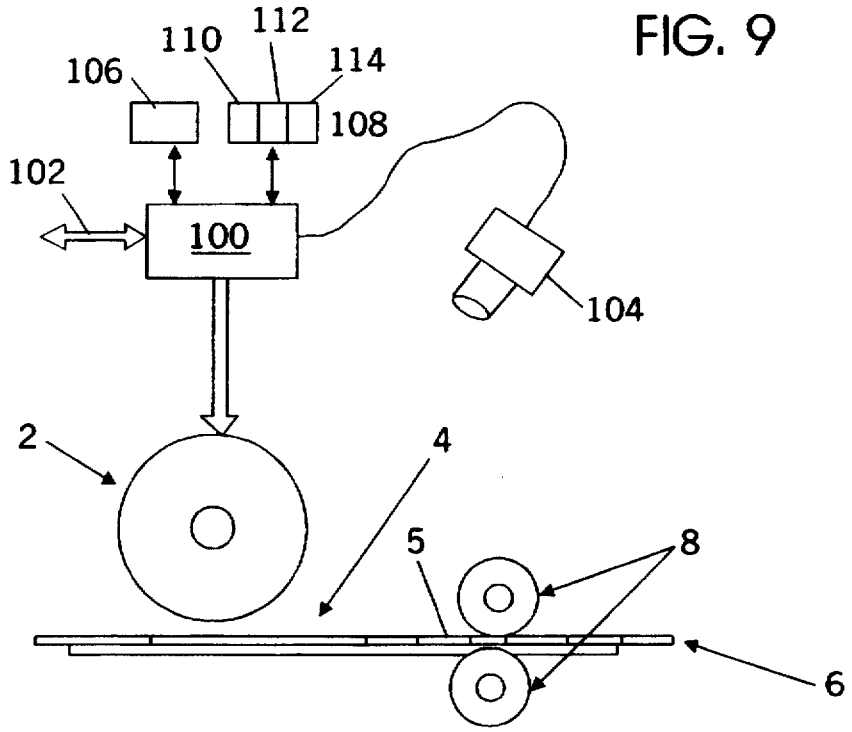
FIG. 9 shows an embodiment of the invention.
FIG. 11 shows a schematic structure of stored values for contact time and/or contact force.

FIG. 9 shows an embodiment according to the invention. Friction roller 2 is coupled to a control means 100. Control means 100 controls the function of friction roller 2, and especially, the contact region between friction roller 2 and page 4. It is to be understood that the coupling between the control means 100 and friction roller 2 can be configured in many different ways, dependent on the specific arrangement of the page turning apparatus. In a preferred embodiment, control means 100 is connected to the control units of horizontal and vertical motors in order to move friction roller 2 in a horizontal and a vertical direction and to apply horizontal and vertical forces on page 4. Control means 100 is connected to a rotation driver of friction roller 2 in order to start and control the rotation of friction roller 2. Control means 100 is further coupled to transportation rollers 8 in order to control the transportation of book 6 in a horizontal direction perpendicular to joint 5.

Control means 100 has a signal input/output line 102 and is further connected to an optical checking means 104, to a store 106 and to a counter 108 which comprises a page turning procedure (PTP) counter 110, a lift retry counter 112 and a turn page retry counter 114. The functions of the counters 110–114 will be explained below.

Figures 10, 10A, 10B:
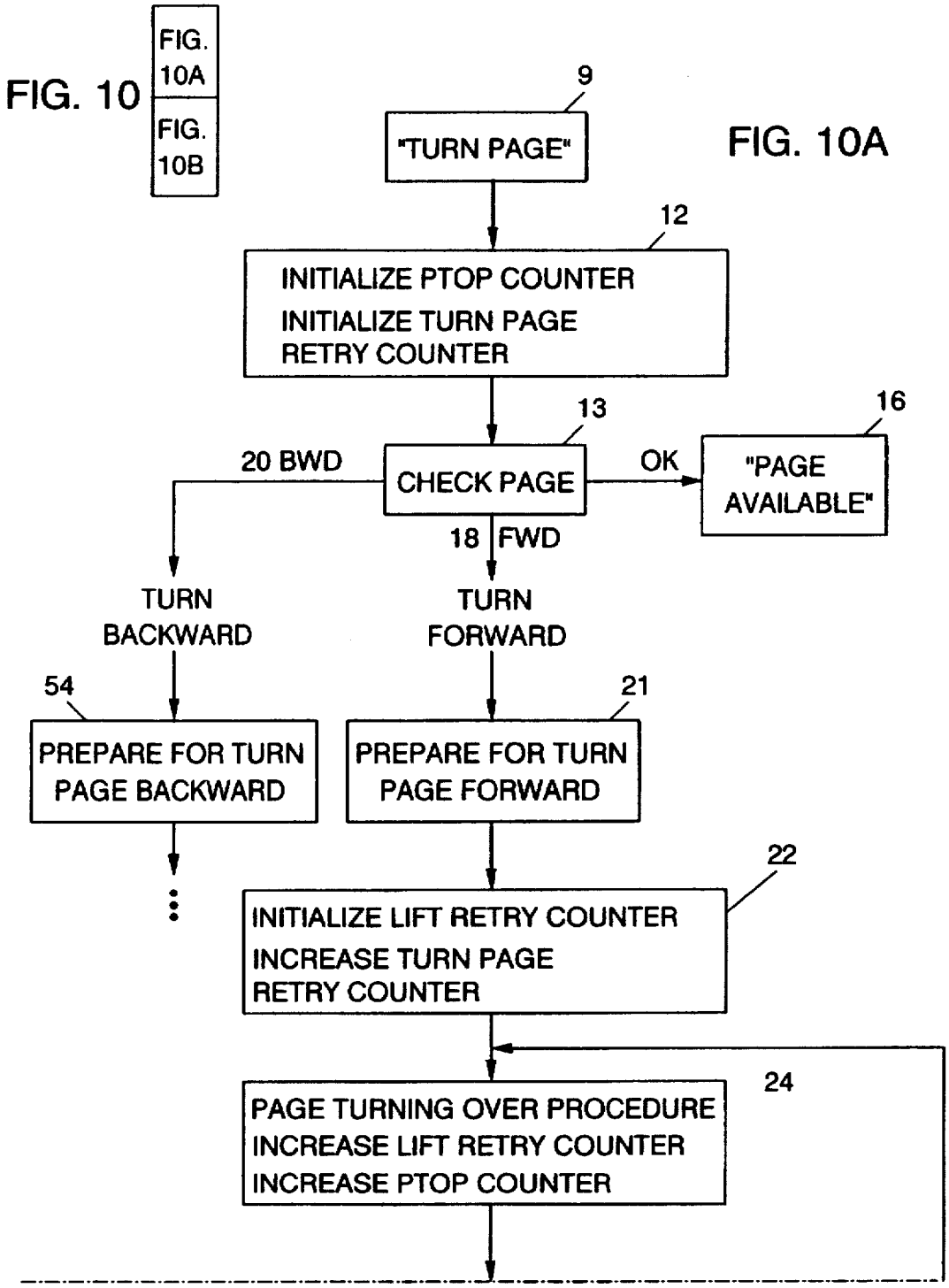
FIG. 10 is a flow diagram of a page turning method according to the invention.
Figure 10B:
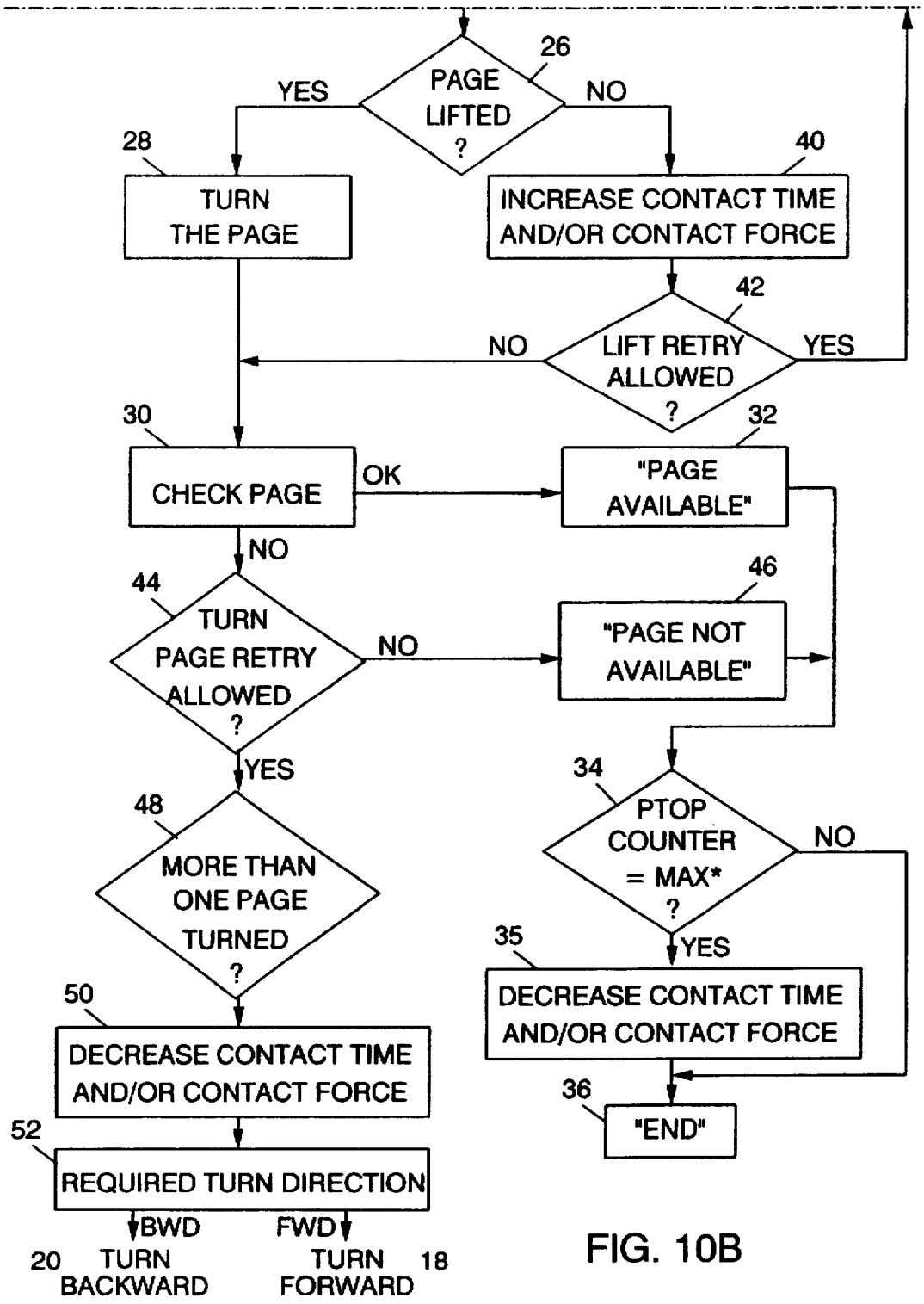

FIG. 10 illustrates the procedure for turning a new page. A "turn page" signal 9 is applied on signal line 102 to control means 100. The "turn page" signal 9 preferably comprises a required page number and a start signal which starts the page turning process. PTP counter 110 and turn page retry counter 114 are initialized to a zero value in step 12 by control means 100.

In step 13, it is determined if the page to be turned is already available, and if so, the current page number is read. This is preferably executed by optical checking means 104 (e.g. an optical sensor), but can be performed by any other means known in the art such as a magnetic sensor or the like. If the page is available, a "page available" signal 16 is issued by control means 100 on signal line 102. Then, the page turn procedure can start according to the preselected turning direction, either forward turning on branch 18, or backwards turning on branch 20. Since there is no principal difference in the process, whether forward or backward direction, the procedure will be explained for forward turning only.

When "page available" signal 16 has been issued, step 21 prepares book 6 for the page turning procedure. The positioning comprises positioning of book 6 in the page turning apparatus by transportation means 8, and a positioning of friction roller 2 on page 4 to be turned, preferably under the control of control means 100. Both positionings are preferably accomplished in a way described in European Patent Application EP-A 94108261.2, entitled "Apparatus for turning over a page in a book", filed on even date herewith (Attorney docket no.: GE994011), or by any other method known in the art.

In step 22, turn page retry counter 114 is increased by one and counts the number of executed preparing steps of step 21. Lift retry counter 112 is initialized and counts the number of turning procedures of succeeding step 24 after preparation step 21. PTP counter 110 counts the total number of turning procedures of step 24 after "turn page" signal 9.

In step 24, the page turning procedure is started and lift retry counter 112 and the PTP counter 110 are increased by one. When the value of the PTP counter 110 is "one", the page turning procedure of step 24 is executed for the first time for a current page. An initial value of a contact force between friction roller 2 and page 4 is applied for an initial value of a contact time for the contact between friction roller 2 and page 4. The initial values are preferably stored in store 106, but can be registered by any other means known in the art.

In a preferred embodiment of the invention, the contact force is kept substantially constant during the turning process and only the contact time is varied. However, the turning procedure can be optimized by a combination of contact time and contact force control. It is clear that the combined variations in contact force and/or contact time open a wide variety of solutions for each specific task. There are many different kinds of books with different characteristics and materials and also various materials possible for friction roller 2, so that a suitable combination has to be found.

The page turning procedure is preferably executed as shown in FIGS. 1 to 8, as described above. Friction roller 2 touches page 4 and starts rotating. The direction of rotation of the contact surface of friction roller 2 is in the direction of joint 5, i.e. counter-clockwise. According to the sequence in FIGS. 3 to 7, the page to be turned is lifted by the frictional force of friction roller 2 until the page is fully lifted over friction roller 2, as shown in FIG. 7.

In step 26, it is checked if page 4 is actually lifted and is positioned according to FIG. 7. In a preferred embodiment, this check is executed by light barrier LB (FIG. 4), or by optical checking means 104, automatically when the applied contact time has elapsed. If page 4 is found in step 26 to be lifted properly, the page is turned in step 28. In a preferred embodiment, step 28 is executed when transport rollers 8 move passbook 6 in the direction of friction roller 2 until the page is finally turned.

In step 30, checking means 104 checks the presently opened new page of the book 6. If the new page is the requested one by "turn page" signal 9, a further "page available" signal 32 is issued. In this embodiment the expected page in the forward turning mode would be the succeeding page and in the backwards turning mode, a preceding page. However, it is clear that, dependent on the objects of the embodiment, more than one page could be turned.

In step 34, the value of PTP counter 110 (which represents the number of executed turning procedures by step 24 since "turn page" signal 9 was applied), is compared with a given maximum number of repeatable turning procedures. If the number of executed turning procedures is less than the given maximum number of repeatable turning procedures, the page turning process is successful, an "end" signal 36 is issued and a next "turn page" signal 9 can be processed for turning a next page.

If the number of carried out turning procedures in step 34 is equal to the given maximum number of repeatable turning procedures, step 35 is executed before "end" signal 36 is issued (and a next "turn page" signal 9 can be processed for turning a next page). In step 35, the last applied value of the contact time and/or contact force is decreased by a predetermined value. This is in order to reduce the affect of an extraordinary stray value out of the normal sequence of contact force and/or contact time values.

In step 34 of a further embodiment of the invention, the current applied value of contact time and/or contact force is compared with a first initial value when the page turning procedure of step 24 is carried out for the first time on a page after "page turn" signal 9. Only when the difference between these values exceeds a predetermined value is step 35 executed. This method is especially useful when the values for increasing or decreasing contact time and/or contact force are not kept constant and can be varied during the process.

In one embodiment of the invention, the last applied value of the contact time and/or the contact force is used as the initial value for the successive turning procedure. This is especially useful when a sequence of successive pages is to be turned, page by page, so that the values of contact time and/or contact force are not likely to differ significantly from a preceding one.

In a further embodiment, initial values are stored in a table with reference to the page number and/or the height of the page relative to the back of the book. FIG. 11 shows a schematic data structure of stored values for contact time and/or contact force. For each page number, an initial minimum and maximum value for contact time and/or contact force is stored in a table, dependent on the direction of page turning. It is clear that these values, and especially the initial values, are modifiable during the use of the table. This allows high flexibility with respect to changing characteristics of the books, tolerances, and normal wear and tear of the mechanical and electrical components.

In a preferred embodiment, the last applied value of contact force and/or contact time for a page successfully turned is stored as the initial value for that page number and is updated after each page turning process is executed. Only if the number of unsuccessful page turning procedures of step 24 is greater than a given number, does the system realize that this must be an extraordinary stray value out of the sequence, e.g. that the pages are stuck together. Then, the current initial value is decreased by a certain predetermined value and stored as the new initial value.

In step 26, the page is checked to determine whether it has been actually lifted. If the page is found in step 26 not to be lifted properly, the contact time and/or contact force is increased by a predetermined value in a succeeding step 40. In a following step 42, the value of the lift retry counter 112 is compared with a predetermined maximum number of allowable page turning procedures of step 24 since a last preparation step 21. In a preferred embodiment, the page turning procedure of step 24 can be executed three times before the page preparation step 21 has to be repeated. If the value of lift retry counter 112 is smaller than a predetermined maximum number of allowable page turning procedures in step 42, the page turning procedure of step 24 is executed again. If the maximum number of allowable page turning procedures is reached, no further page turning procedure of step 24 is allowed and step 30 is executed next.

In step 30, checking means 104 checks the page number of book 6. If the page is not the one requested by "turn page" signal 9, a step 44 is executed. In step 44, the value of turn page retry counter 114 is compared with a predetermined maximum number of allowable turn page retries started from preparation step 21. If the value of the turn page retry counter 114 is equal to the maximum number of allowable turn page retries, a "page not available" signal 46 is issued and step 34 is executed next. If the value of the turn page retry counter 114 is less than the maximum number of allowable turn page retries in step 44, step 48 is carried out.

In step 48, data about page numbers of step 13 and step 30 are compared and it is determined whether more than one page has been turned. If more than one page has been turned, the value of the contact time and/or contact force is decreased by a determined value in step 50. In many applications, the turning of several pages simultaneously is not intended but can be accepted in order to quickly reach a certain page number. The value to which the contact force and/or contact time is decreased is therefore dependent on whether the turning of multiple pages is acceptable. In any case, the turning of multiple pages should be avoided, since the book can be damaged thereby.

Step 52 is executed after step 48 if only one page has been turned, or if the value of the contact time and/or contact force has been decreased in step 50. In step 52, the required page turning direction is determined. If the current page number is smaller than the page number required by "turn page" signal 9, turning forward branch 18 is selected and the process starts again from step 21. If the current page number is greater than the page number required by the "turn page" signal 9, turning backwards branch 20 is selected and the process starts from step 54 which is basically the same as step 21. The preparation steps in step 21 and 54 will then take into account that the turning direction is opposite. However, the following procedures are according to the explanations for steps 21 to 52 (for both turning directions).

It is clear that the forward turning process 18 and backwards turning process 20 are basically the same, with the exception of different preparation steps 21 and 54. Also, the applied initial values of contact time and/or contact force differ. It is clear that, except from the middle of the book, the height of the page relative to the back of the book depends on the turning direction.

In a preferred embodiment of the invention, the maximum number of allowable turn retries is limited to three. In case the maximum number of lift retries is also three, the page turning procedure of step 21 can be executed nine times on the page to be turned. The separate counting of lift retries and turn page retries allows an optimized page turning process. When, after a maximum number of lift retries, the page is still not lifted, it is likely that either an unidentified error has happened in preparation and positioning step 21, or that the positioning of the book relative to lifting means 2 was not optimal, or another error has occurred. A further successful turning procedure, even with an increased value of contact time and/or contact force, is very unlikely to achieve the desired page lifting result, but could damage the page by applying too much force on the page.

It has been shown that a further preparation and positioning step 21 is very effective and reduces the likelihood of damaging the page. In case the page is still not liftable after a certain number of preparation steps 21 and page turning procedures (step 24), it is presumed that a severe error has happened and the entire process is interrupted or aborted by issuance of a "page not available" signal 46 and process "end" signal 36.

In one embodiment of the invention, the initial values of contact time and/or contact force are stored during an interactive teaching procedure. The pages of a first book will be turned, page by page, whereby a most appropriate value of contact time and/or contact force is determined and stored for each page number or for each height of the page relative to the back of the book and for each turning direction.

In another embodiment of the invention, the current applied value of contact time and/or contact force are stored after steps 35, 40 and 50 and replace the former initial value as a new initial value of contact time and/or contact force. This allows a continuous adaption of the initial values to changing characteristics of the apparatus, due to normal wear and tear, and to changing characteristics due to different materials and the state of the book.

The invention is preferably applicable for turning pages in savings passbook printers. However, the teaching can be used to improve all kinds of page turning processes. Especially for electrical book readers or book scanners with an automatic page turning function, the invention increases the speed and the reliability of the turning process. It is clear that a stored table with the initial and applicable values of contact time and/or contact force for each page according to FIG. 11 is preferably used when the variation in the characteristics of the books is limited and only are certain types of books are likely to be used. In case of a book reading apparatus and different types of books, it is advantageous to start with a low value of contact time and/or force and use the last applied value of a page successfully turned over in the forwards direction as the initial value for a next page.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A method for turning a page of a book comprising the steps of:

applying an initial value of a contact force between a lifting means and the page;

increasing the initial value of the contact force when no page has been lifted during a page turning procedure;

employing a last applied value of the contact force as an initial value when a next page is to be turned; and decreasing the value of the contact force when more than one page has been lifted during a page turning procedure.

2. The method according to claim 1, wherein a last applied value of the contact force is only applied as an initial value when a given value of a difference between a current initial value and the last applied value is not exceeded.

3. The method according to claim 1, further comprising the steps of:

checking at least one of: (i) a number of the page to be turned in the book or (ii) a height of the page relative to a back of the book; and selecting the initial value of the contact force dependent on:

the number of the page or the height of the page relative to the back of the book as respectively determined by the checking step, and a direction of turning the page in the book.

4. The method according to claim 1, comprising the further step of:

repositioning the page relative to the lifting means when the page turning procedure is unsuccessfully tried a predetermined number of times.

5. The method according to claim 4, wherein said applying step for turning one page is only operated a second predetermined number of times.

6. Apparatus for turning a page in a book comprising:

lifting means for lifting the page; and control means for controlling a contact force between the lifting means and the page, said control means increasing a value of the contact force when no page has been lifted during a page turning procedure, decreasing said value of the contact force when more than one page has been lifted during a page turning procedure, and employing as an initial value, a last applied value of the contact force when a next page is provided to be turned.

7. The apparatus according to claim 6, further comprising:

checking means for checking at least one of (i) a number of the page to be turned (ii) a height of the page relative to a back of the book, whereby the initial value of the contact force is selectable dependent on the number of the page or the thickness of the book as respectively checked by said checking means.

8. The apparatus according to claim 6, wherein said value of the contact force is in a range between minimum and maximum values.

9. The apparatus according to claim 6, further comprising:

means for storing values of the contact force and initial values of the contact force.

10. The apparatus according to claim 6, further comprising;

means for user-entry of said initial value of the contact force.

11. The apparatus according to claim 6, wherein said apparatus is either a savings passbook printer, or an automatic book scanner.

12. A method for turning a page of a book comprising the steps of:

applying an initial value of a contact time for contact between a lifting means and the page;

increasing the initial value of the contact time when no page has been lifted during a page turning procedure;

employing a last applied value of the contact time as an initial value when a next page is to be turned; and decreasing the value of the contact time when more than one page has been lifted during a page turning procedure.

13. The method according to claim 12, wherein the last applied value of the contact time is only applied as an initial value when a given value of a difference between a current initial value and the last applied value is not exceeded.

14. The method according to claim 12, further comprising the further step of:

checking at least one of (i) a number of the page to be turned in the book or (ii) a height of the page relative to a back of the book; and selecting the initial value of the contact time dependent on:

the number of the page or the height of the page relative to the back of the book as respectively determined by said checking step, and a direction of turning the page in the book.

15. The method according to claim 12, comprising the further step of:

repositioning the page relative to the lifting means when the page turning procedure is unsuccessfully tried a predetermined number of times.

16. The method according to claim 15, wherein said applying step for turning one page is only operated a second predetermined number of times.

17. Apparatus for turning a page in a book comprising:

lifting means for lifting the page; and control means for controlling a contact time for contact between the lifting means and the page, said control means increasing a value of the contact time when no page has been lifted during a page turning procedure, decreasing said value of the contact time when more than one page has been sifted during a page turning procedure, and employing as an initial value, a last applied value of the contact time when a next page is provided to be turned.

18. The apparatus according to claim 17, further comprising:

checking means for checking at least one of (i) a number of the page to be turned or (ii) a height of the page relative to a back of the book, whereby the initial value of the contact time is selectable dependent on the number of the page or the thickness of the book, as checked by said checking means, respectively.

19. The apparatus according to claim 17, wherein said value of the contact time is in a range between minimum and maximum values.

20. The apparatus according to claim 17, further comprising:

means for storing values of contact time and initial values of the contact time.

21. The apparatus according to claim 17, further comprising:

means for user-entry of said initial value of the contact time.

22. The apparatus according to claim 17, wherein said apparatus is either a savings passbook printer, or an automatic book scanner.

* * * * *